US010283057B2

(12) United States Patent
Reddy et al.

(10) Patent No.: US 10,283,057 B2
(45) Date of Patent: May 7, 2019

(54) HEURISTIC LEARNING FOR SETTING AUTOMATIC DISPLAY BRIGHTNESS BASED ON AN AMBIENT LIGHT SENSOR

(71) Applicant: Dell Products L.P., Round Rock, TX (US)

(72) Inventors: Karun Palicherla Reddy, Austin, TX (US); Bradford Edward Vier, Austin, TX (US); Rex W. Bryan, Round Rock, TX (US); Anand Prakash Joshi, Round Rock, TX (US)

(73) Assignee: Dell Products L.P., Round Rock, TX (US)

( * ) Notice: Subject to any disclaimer, the term of this patent is extended or adjusted under 35 U.S.C. 154(b) by 65 days.

(21) Appl. No.: 15/416,866

(22) Filed: Jan. 26, 2017

(65) Prior Publication Data

US 2018/0211608 A1 Jul. 26, 2018

(51) Int. Cl.

| | |
|---|---|
| ***G09G 3/34*** | (2006.01) |
| ***G09G 3/36*** | (2006.01) |
| ***G09G 3/20*** | (2006.01) |

(52) U.S. Cl.

CPC ..... *G09G 3/3406* (2013.01); *G09G 3/2092* (2013.01); *G09G 3/36* (2013.01); *G09G 2320/0606* (2013.01); *G09G 2320/0626* (2013.01); *G09G 2320/0693* (2013.01); *G09G 2320/08* (2013.01); *G09G 2354/00* (2013.01); *G09G 2360/144* (2013.01); *G09G 2360/16* (2013.01)

(58) Field of Classification Search

CPC ..... G09G 3/3406; G09G 2320/0626; G09G 2320/0693; G09G 2354/00; G09G 2360/144; G09G 2360/16; G09G 2320/0606; G09G 2320/0653

See application file for complete search history.

(56) References Cited

U.S. PATENT DOCUMENTS

| | | | | |
|---|---|---|---|---|
| 5,554,912 | A * | 9/1996 | Thayer | H05B 39/042 307/10.8 |
| 5,760,760 | A * | 6/1998 | Helms | G09G 3/36 345/102 |
| 2005/0190142 | A1* | 9/2005 | Ferguson | G09G 3/3406 345/102 |
| 2006/0092182 | A1* | 5/2006 | Diefenbaugh | G06F 1/3218 345/690 |
| 2013/0328842 | A1* | 12/2013 | Barnhoefer | G09G 3/3406 345/207 |

* cited by examiner

*Primary Examiner* — Patrick N Edouard
*Assistant Examiner* — Douglas M Wilson
(74) *Attorney, Agent, or Firm* — Baker Botts L.L.P.

(57) ABSTRACT

A heuristic learning algorithm uses an ALS to determine display brightness settings based on a stored response curve for display brightness for a user. When the user overrides the response curve value for display brightness at a given ALS output, the display brightness setting based on the user input is used to modify the response curve for the ALS output to lesser extent than the user input. Over time the response curve will approach desired user settings for each value of the ALS output.

17 Claims, 3 Drawing Sheets

HEURISTIC LEARNING FOR SETTING AUTOMATIC DISPLAY BRIGHTNESS BASED ON AN AMBIENT LIGHT SENSOR

BACKGROUND

Field of the Disclosure

This disclosure relates generally to information handling system displays and, more particularly, to heuristic learning for setting automatic display brightness based on an ambient light sensor.

Description of the Related Art

As the value and use of information continues to increase, individuals and businesses seek additional ways to process and store information. One option available to users is information handling systems. An information handling system generally processes, compiles, stores, and communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Display devices, such as liquid crystal displays (LCDs) are commonly used to display content to users. The display devices generally have a brightness setting that can be manually adjusted to change the overall luminescence of the display screen, such as by changing the intensity of a backlight used with an LCD or by other means. Some information handling systems include an ambient light sensor (ALS) that is used for automatic brightness settings.

SUMMARY

In one aspect, a disclosed method is for brightness control in information handling systems. The method may include receiving an ambient light sensor (ALS) output at an information handling system. In the method, the ALS output may be indicative of ambient light levels in proximity to the information handling system, and the ALS output may be linearly scaled with respect to a display brightness of a display used with the information handling system. The method may also include modifying the display brightness based on a response curve stored for a user of the information handling system and the ALS output, the response curve for calibrating display brightness values positively versus the ALS output, and receiving user input to make a change in the display brightness, the change corresponding to a first brightness difference. In the method, the ALS output may not change after the display brightness is modified based on the response curve and before the user input is received. The method may further include calculating a second brightness difference smaller than the first brightness difference and having the same sign as the first brightness difference, modifying a display brightness value in the response curve corresponding to the ALS output by the second brightness difference to generate an updated response curve, and storing the updated response curve for the user in place of the response curve.

In any of the disclosed embodiments of the method, calculating the second brightness difference may further include calculating the second brightness difference $\Delta 2$ from the first brightness difference $\Delta 1$ based on the equation $\Delta 2 = F \times \Delta 1$, where F is a positive confidence factor less than 1.

In any of the disclosed embodiments of the method, modifying the display brightness value in the response curve may not be performed when the second brightness difference value results in any point in the response curve having a negative or zero slope.

In any of the disclosed embodiments of the method, the positive confidence factor F may be selected to prevent any point in the response curve having a negative or zero slope.

In any of the disclosed embodiments of the method, modifying the display brightness may be performed using a timed transition from an old display brightness to a new display brightness over a predetermined time.

In any of the disclosed embodiments of the method, the predetermined time may be shorter when the new display brightness is greater than the old display brightness than when the new display brightness is lower than the old display brightness.

In any of the disclosed embodiments of the method, the user input may be subject to a minimum change sensitivity with respect to the display brightness and a minimum change response interval from a previous user input to change the display brightness. In the method, the user input may not be accepted when the minimum change sensitivity and the minimum change response interval are not satisfied.

Other disclosed aspects include a non-transitory computer-readable medium storing instructions executable by a processor unit, and an information handling system.

BRIEF DESCRIPTION OF THE DRAWINGS

For a more complete understanding of the present invention and its features and advantages, reference is now made to the following description, taken in conjunction with the accompanying drawings, in which.

DESCRIPTION OF PARTICULAR EMBODIMENT(S)

Figure 1:
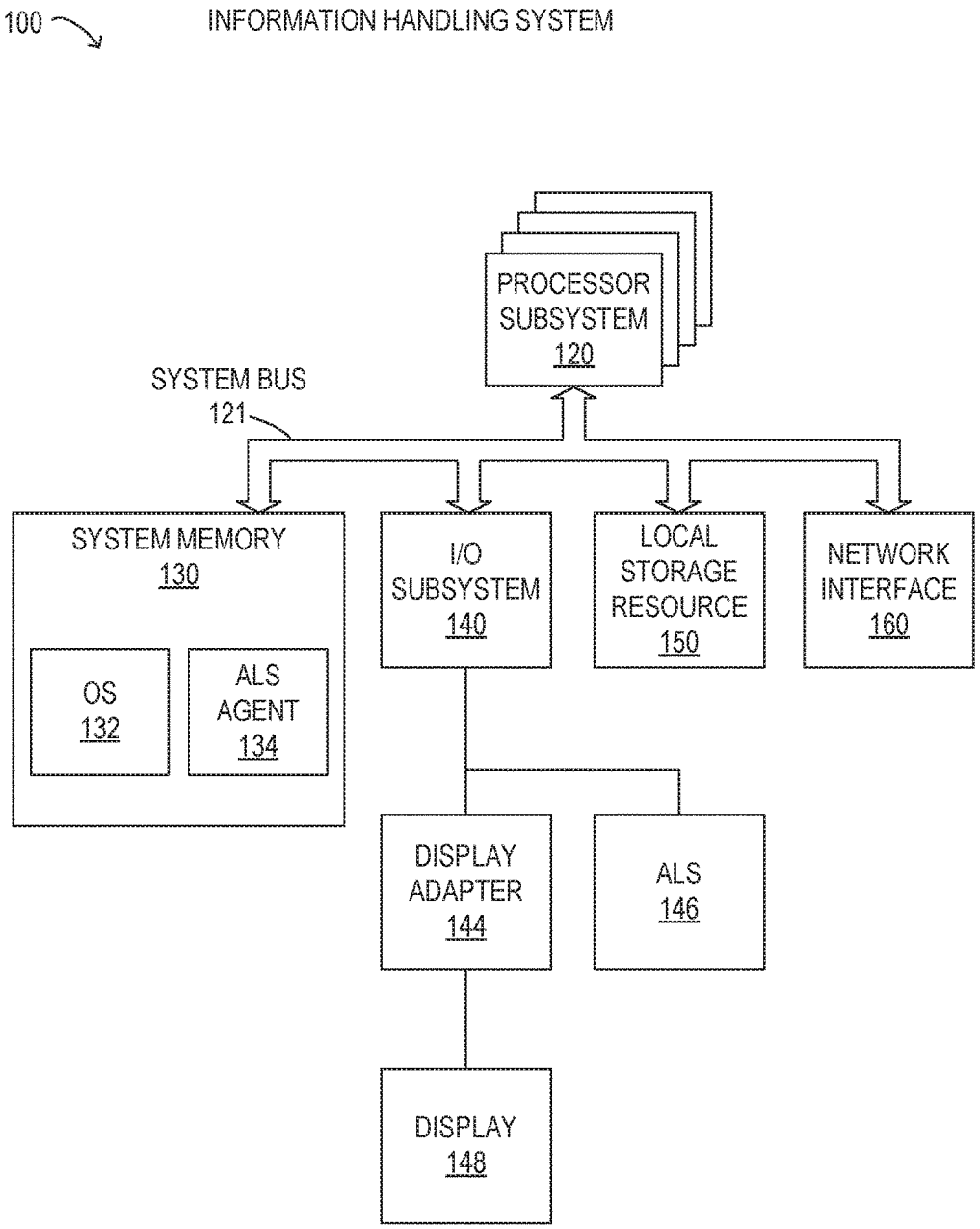
FIG. 1 is a block diagram of selected elements of an embodiment of an information handling system.

In the following description, details are set forth by way of example to facilitate discussion of the disclosed subject matter. It should be apparent to a person of ordinary skill in the field, however, that the disclosed embodiments are exemplary and not exhaustive of all possible embodiments.

As used herein, a hyphenated form of a reference numeral refers to a specific instance of an element and the unhyphenated form of the reference numeral refers to the collective or generic element. Thus, for example, widget "72-1" refers to an instance of a widget class, which may be referred to collectively as widgets "72" and any one of which may be referred to generically as a widget "72".

For the purposes of this disclosure, an information handling system may include an instrumentality or aggregate of instrumentalities operable to compute, classify, process, transmit, receive, retrieve, originate, switch, store, display, manifest, detect, record, reproduce, handle, or utilize various forms of information, intelligence, or data for business, scientific, control, entertainment, or other purposes. For example, an information handling system may be a personal computer, a PDA, a consumer electronic device, a network storage device, or another suitable device and may vary in size, shape, performance, functionality, and price. The information handling system may include memory, one or more processing resources such as a central processing unit (CPU) or hardware or software control logic. Additional components or the information handling system may include one or more storage devices, one or more communications ports for communicating with external devices as well as various input and output (I/O) devices, such as a keyboard, a mouse, and a video display. The information handling system may also include one or more buses operable to transmit communication between the various hardware components.

For the purposes of this disclosure, computer-readable media may include an instrumentality or aggregation of instrumentalities that may retain data and instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), or flash memory (SSD), as well as communications media such wires, optical fibers, microwaves, radio waves, and other electromagnetic or optical carriers, or any combination of the foregoing.

As noted, certain information handling systems may employ an ALS to monitor ambient light conditions in order to automatically adjust display brightness. For example, Microsoft Windows provides "Adaptive Brightness" as an operating system feature that changes display brightness based on ALS output. However, the implementation of ALS-based automatic display brightness may suffer from poor user experience. Typically ALS-based automatic display brightness may employ fixed static response settings, which are based on artificial lighting conditions and exposed to the operating system. Then, a limited modification of the screen brightness settings based on the environmental lighting conditions is permitted during operation of the information handling system. However, identifying screen brightness settings that satisfy the needs of all demographics of users remains an elusive challenge. For example, different users may be comfortable with very different response curves for lighting and display brightness, such as due to age and vision quality having an impact on a user's comfort level with given lighting and display brightness. Very often, users are bypassing the use of the ALS due to the poor implementation of current ALS-based automatic display brightness.

As disclosed herein, a heuristic learning algorithm is used for setting automatic display brightness based on an ALS. The heuristic learning ALS-based automatic display brightness disclosed herein may enable users to generate and maintain customized response curves for ambient lighting and display brightness that can be used for setting automatic display brightness. The heuristic learning ALS-based automatic display brightness disclosed herein may learn a user's preferences over time in a manner that adapts to a user's individual preferences for screen brightness based versus ambient light conditions.

Figure 2:
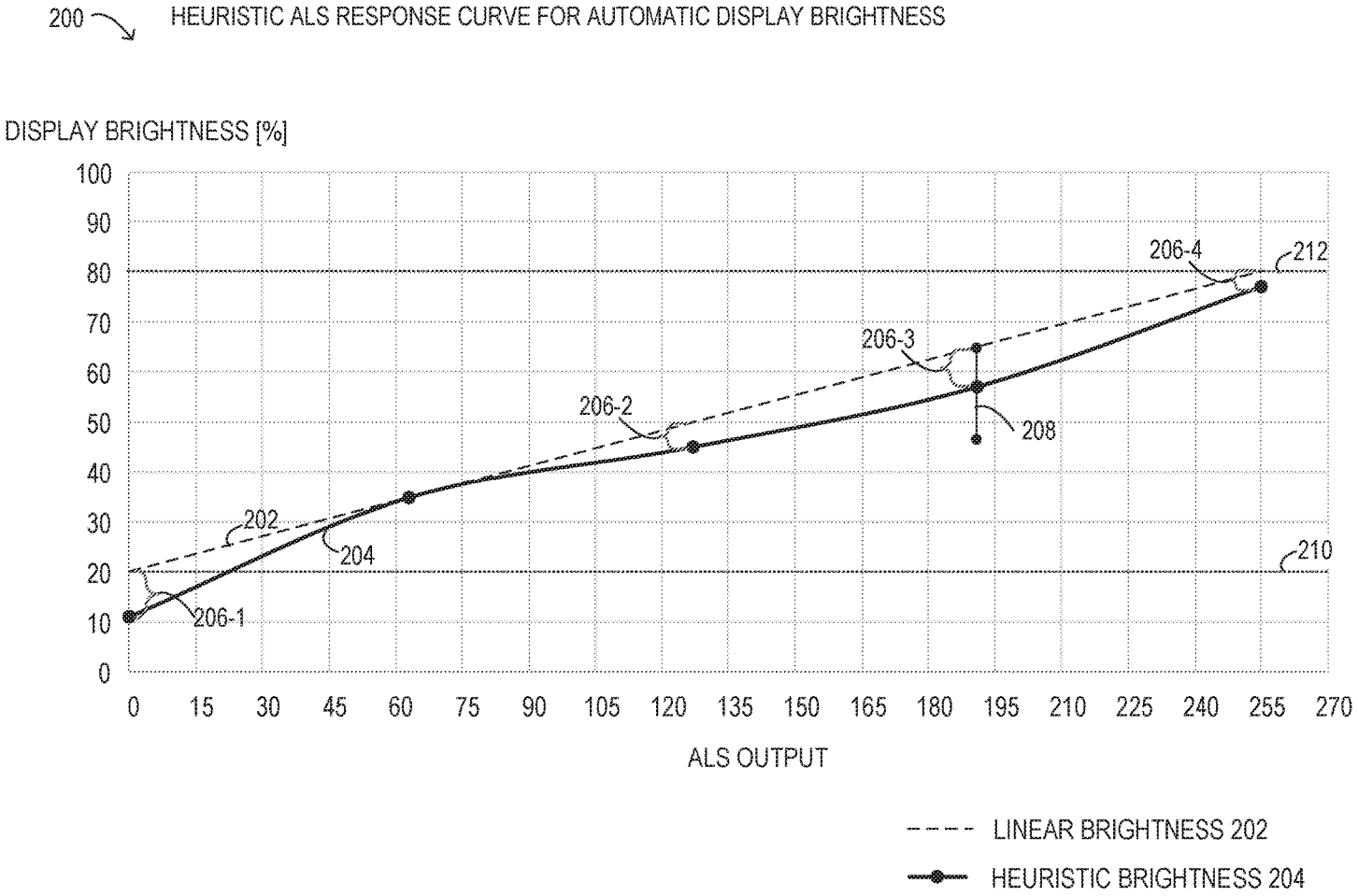
FIG. 2 is a response curve for automatic display brightness.
Figure 3:
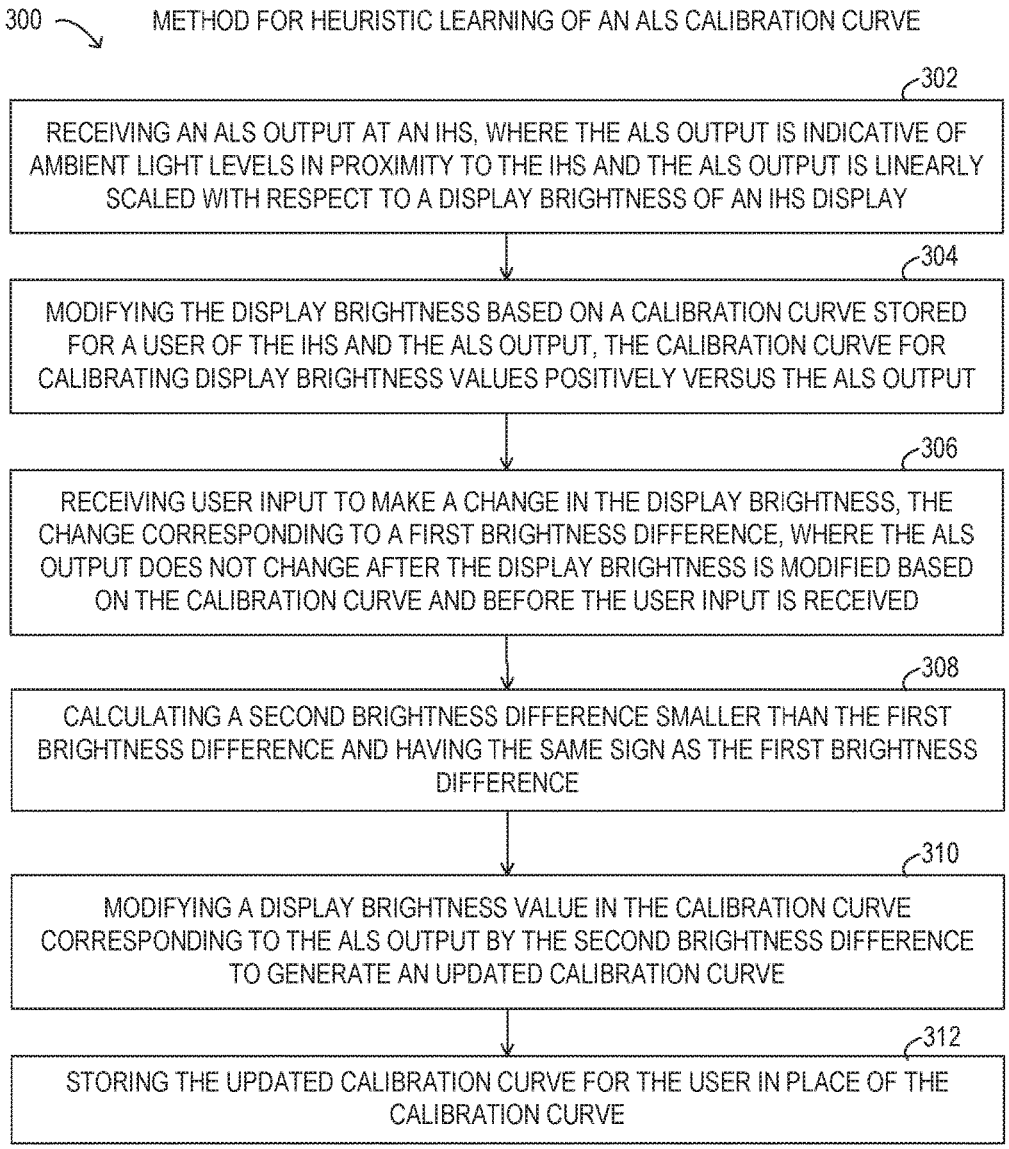
FIG. 3 is flowchart depicting selected elements of an embodiment of a heuristic method for learning an ALS response curve.

Particular embodiments are best understood by reference to FIGS. 1, 2, and 3 wherein like numbers are used to indicate like and corresponding parts.

Turning now to the drawings, FIG. 1 illustrates a block diagram depicting selected elements of an embodiment of information handling system 100. As described herein, information handling system 100 may represent a personal computing device, such as a personal computer system, a desktop computer, a laptop computer, a notebook computer, etc., operated by a user. In various embodiments, information handling system 100 may be operated by the user using a keyboard and a mouse (not shown).

As shown in FIG. 1, components of information handling system 100 may include, but are not limited to, processor subsystem 120, which may comprise one or more processors, and system bus 121 that communicatively couples various system components to processor subsystem 120 including, for example, a system memory 130, an I/O subsystem 140, local storage resource 150, and a network interface 160. System bus 121 may represent a variety of suitable types of bus structures, e.g., a memory bus, a peripheral bus, or a local bus using various bus architectures in selected embodiments. For example, such architectures may include, but are not limited to, Micro Channel Architecture (MCA) bus, Industry Standard Architecture (ISA) bus, Enhanced ISA (EISA) bus, Peripheral Component Interconnect (PCI) bus, PCI-Express bus, HyperTransport (HT) bus, and Video Electronics Standards Association (VESA) local bus.

In FIG. 1, network interface 160 may be a suitable system, apparatus, or device operable to serve as an interface between information handling system 100 and a network (not shown). Network interface 160 may enable information handling system 100 to communicate over the network using a suitable transmission protocol or standard. In some embodiments, network interface 160 may be communicatively coupled via the network to a network storage resource (not shown). The network coupled to network interface 160 may be implemented as, or may be a part of, a storage area network (SAN), personal area network (PAN), local area network (LAN), a metropolitan area network (MAN), a wide area network (WAN), a wireless local area network (WLAN), a virtual private network (VPN), an intranet, the Internet or another appropriate architecture or system that facilitates the communication of signals, data and messages (generally referred to as data). The network coupled to network interface 160 may transmit data using a desired storage or communication protocol, including, but not limited to, Fibre Channel, Frame Relay, Asynchronous Transfer Mode (ATM), Internet protocol (IP), other packet-based protocol, small computer system interface (SCSI), Internet SCSI (iSCSI), Serial Attached SCSI (SAS) or another transport that operates with the SCSI protocol, advanced technology attachment (ATA), serial ATA (SATA), advanced technology attachment packet interface (ATAPI), serial storage architecture (SSA), integrated drive electronics (IDE), or any combination thereof. The network coupled to network interface 160 and various components associated therewith may be implemented using hardware, software, or any combination thereof.

As depicted in FIG. 1, processor subsystem 120 may comprise a system, device, or apparatus operable to interpret and execute program instructions and process data, and may include a microprocessor, microcontroller, digital signal processor (DSP), application specific integrated circuit (ASIC), or another digital or analog circuitry configured to interpret and execute program instructions and process data. In some embodiments, processor subsystem 120 may interpret and execute program instructions and process data stored locally (e.g., in system memory 130). In the same or alternative embodiments, processor subsystem 120 may interpret and execute program instructions and process data stored remotely (e.g., in a network storage resource, not shown).

Also in FIG. 1, system memory 130 may comprise a system, device, or apparatus operable to retain and retrieve program instructions and data for a period of time (e.g., computer-readable media). As shown in the example embodiment of FIG. 1, system memory 130 stores an operating system (OS) 132, which may represent instructions executable by processor subsystem 120 to operate information handling system 100 after booting. System memory 130 also stores ALS agent 134, which may be executable code for implementing the heuristic learning algorithm used for setting automatic display brightness based on an ALS, as disclosed herein. ALS agent 134 may be executed under OS 132, such as a service or an application. It is noted that in different embodiments, operating system 132 may be stored at a network storage resource (not shown) and may be accessed by processor subsystem 120 via a network (not shown). System memory 130 may comprise random access memory (RAM), electrically erasable programmable read-only memory (EEPROM), a PCMCIA card, flash memory, magnetic storage, opto-magnetic storage, or a suitable selection or array of volatile or non-volatile memory that retains data after power to its associated information handling system, such as information handling system 100, is powered down.

Local storage resource 150 may comprise computer-readable media (e.g., hard disk drive, floppy disk drive, CD-ROM, or other type of rotating storage media, flash memory, EEPROM, or another type of solid state storage media) and may be generally operable to store instructions and data.

In information handling system 100, I/O subsystem 140 may comprise a system, device, or apparatus generally operable to receive and transmit data to or from or within information handling system 100. I/O subsystem 140 may represent, for example, a variety of communication interfaces, graphics interfaces, video interfaces, user input interfaces, and peripheral interfaces, which are not shown for descriptive clarity. As shown, I/O subsystem 140 provides an interface for a display adapter 144, which may provide connectivity for display 148, which may be an external display or a display included with information handling system 100. I/O subsystem 400 may also provide an interface for ALS 146, which may be integrated within information handling system 100.

In operation, information handling system 100 may use ALS 146 to monitor ambient lighting conditions in proximity of information handling system 100. The output from ALS 146 may be used as a reference when user input for setting the brightness of display 148 is received from a user. Based on the user input, a response curve for ambient light versus display brightness may be heuristically adapted and learned for the user.

Turning now to FIG. 2, a heuristic ALS response curve 200 (also simply referred to as response curve 200) for automatic display brightness is shown. It is noted that response curve 200 is an exemplary embodiment of one particular implementation of a response curve shown for descriptive purposes and that it will be understood that the methods described herein may be applicable to various different response curves with different values. Response curve 200 may be referred to as an 'ambient light response curve' and is different from a calibration curve (not shown) for ALS 146, which matches an ALS output signal correctly with an actual light level detected by ALS 146. Thus, while response curve 200 may change and adapt in response to user input, as described herein, the calibration curve (not shown) for ALS 146 does not change in response to user input.

In FIG. 2, response curve 200 shows values for display brightness versus ALS output. Display brightness is shown on a scale of 0-100% on the Y-axis of response curve 200, while ALS output is shown with an 8-bit digital integer scale which is linearly scaled with respect to display brightness. In other words, the output of the ALS has been scaled to be linearly proportional to display brightness, even when illuminance measured by the ALS is actually non-linear with display brightness. Response curve 200 determines scaling for the linear proportionality between ALS output and display brightness.

In FIG. 2, response curve 200 shows a linear brightness 202 as well as a heuristic brightness 204. Linear brightness 202 may represent a static response curve that is preprogrammed with ALS 146 for use with OS 132. Heuristic brightness 204 may represent an adaptive response curve that is generated according to the methods described herein.

As shown in response curve 200, linear brightness 202 is scaled from a minimum value 210 to a maximum value 212 over the entire range of ALS output. In typical implementations of automatic brightness control, a user may be able to adjust the values for minimum value 210, maximum value 212, or both, such as when making manual user input to adjust screen brightness when automatic brightness control is activated. However, because of the fixed linear nature of linear brightness 202, the mere adjustment of minimum value 210, maximum value 212, or both, may only provide limited learning of a user's preferences over the ALS output scale.

In contrast to the static nature of linear brightness 202, heuristic brightness 204 may be an adapted function that has different positive slopes at different points along the ALS output scale. Although heuristic brightness 204 is described having 5 data points herein for clarity, it will be understood that any number of data points may be stored in a response curve in different embodiments. Specifically, the values shown in Table 1 below correspond to response curve 200 in FIG. 2.

TABLE 1

Data for response curve 200 in FIG. 2.

| ALS output | Linear Brightness 202 [%] | Heuristic Brightness 204 [%] | Difference 206 (204 − 202) [%] |
|---|---|---|---|
| 0 | 20 | 11 | −9 |
| 63 | 35 | 35 | 0 |
| 127 | 50 | 45 | −5 |

TABLE 1-continued

Data for response curve 200 in FIG. 2.

| ALS output | Linear Brightness 202 [%] | Heuristic Brightness 204 [%] | Difference 206 (204 − 202) [%] |
|---|---|---|---|
| 191 | 65 | 57 | −8 |
| 255 | 80 | 77 | −3 |

In FIG. 2, the first data point at ALS output=0 shows a difference 206-1 of −9%; the second data point at ALS output=63 shows a difference of 0 (not shown); the third data point at ALS output=127 shows a difference 206-2 of −5%; the fourth data point at ALS output=191 shows a difference 206-3 of −8%; and the fifth data point at ALS output=255 shows a difference 206-4 of −3%. Although negative values for difference 206 are shown, it will be understood that positive values for difference 206 may be used. Difference 206 shows variations of linear brightness 202 that result in heuristic brightness 204. Difference 206 are generated in response to user input. For example, at ALS output=191, user input may be received to lower the screen brightness from 65% to 48%, representing a first brightness difference $\Delta 1=-17\%$. Then, a confidence factor F may be applied to $\Delta 1$ to generate difference 206-3 ($\Delta 2$) according to the equation $\Delta 2=F\times\Delta 1$, where F is a positive integer less than 1. In various embodiments, F may be between 0.25 and 0.75, between 0.45 and 0.55, around 0.5, around 0.7, or other values and ranges.

Furthermore, the user input to adapt response curve 200 may be subject to certain limits or filters. For example, linear brightness 202 is a positive function over the ALS output and heuristic brightness 204 may also be constrained to remain a positive function of the ALS output having no points with negative or zero slope, no discontinuities. A smooth interpolation among the data points may be assumed for heuristic brightness 204. In some instances, the value of F may be chosen to maintain heuristic brightness 204 as a positive function of the ALS output, for example, by reducing an absolute value of $\Delta 2$ from user input defining $\Delta 1$. Furthermore, the user input may be subject to a minimum change sensitivity before acceptance as the first brightness difference $\Delta 1$, such as at least 30% brightness, as one example. The user input may also be subject to a minimum change response interval, such as at least 3000 ms, from the last user input for brightness control. In this manner, spurious and other deleterious user input may be avoided.

Additionally, when either linear brightness 202 or heuristic brightness 204 are activated and in effect, a change in the ALS output will automatically trigger a change in the display brightness, according to the respective response curve being applied. For such transitions in display brightness, a transition time using a predetermined time may be applied, instead of an abrupt or sudden change in the display brightness. In this regard, a change to a larger display brightness from a lower display brightness (increase in display brightness) may be associated with a shorter transition time, such as 10 s, 15 s, 30 s, or less than 45 s, as examples. However, a change to a lower display brightness from a larger display brightness (decrease in display brightness) may be associated with a longer transition time, such as 60 s, 90 s, or 180 s, as examples, because the human eye has a longer response time to dilate pupils for low light conditions than to narrow pupils for bright light conditions. It is noted that the transition may be nonlinear in terms of change in display brightness over the transition time.

Furthermore, it is noted that the method described herein may be used in various implementations, including under Microsoft Windows with Adaptive Brightness where the operating system stores linear brightness 202. In such instances, heuristic brightness 204 may be stored by storing differences 206 which are used to calculate heuristic brightness 204 instead of using linear brightness 202, which may be substantially equivalent to replacing linear brightness 202 with heuristic brightness 204.

Referring now to FIG. 3, a block diagram of selected elements of an embodiment of method 300 for heuristic learning of an ALS response curve, as described herein, is depicted in flowchart form. In various embodiments, method 300 is performed by ALS agent 134 (see FIG. 1), for example using instructions executable by processor subsystem 120. It is noted that certain operations described in method 300 may be optional or may be rearranged in different embodiments.

In FIG. 3, method 300 begins at step 302 by receiving an ALS output at an IHS, where the ALS output is indicative of ambient light levels in proximity to the information handling system (IHS) and the ALS output is linearly scaled with respect to a display brightness of an IHS display. At step 304, the display brightness is modified based on a response curve stored for a user of the IHS and the ALS output, the response curve for calibrating display brightness values positively versus the ALS output. At step 306, user input is received to make a change in the display brightness, the change corresponding to a first brightness difference, where the ALS output does not change after the display brightness is modified based on the response curve and before the user input is received. At step 308, a second brightness difference is calculated that is smaller than the first brightness difference and has the same sign as the first brightness difference. Thus, the first brightness difference and the second brightness difference are either both positive or both negative. At step 310, a display brightness value is modified in the response curve corresponding to the ALS output by the second brightness difference to generate an updated response curve. Generating the updated response curve may involve simply calculating the differences for each value of the ALS output. At step 312, the updated response curve is stored for the user in place of the response curve. Storing the updated response curve may involve simply storing the differences. It is noted that method 300 may be implemented for a particular user on the IHS, such as under a user account in the operating system. In this manner, the updated response curve may be generated for each individual user of the IHS and may be adapted over time to adjust to the user's personal preferences for display brightness.

As described herein, a heuristic learning algorithm uses an ALS to determine display brightness settings based on a stored response curve for display brightness for a user. When the user overrides the response curve value for display brightness at a given ALS output, the display brightness setting based on the user input is used to modify the response curve for the ALS output to lesser extent than the user input. Over time the response curve will approach desired user settings for each value of the ALS output.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

What is claimed is:

1. A method for brightness control in information handling systems, the method comprising:

receiving an ambient light sensor (ALS) output at an information handling system, wherein the ALS output is indicative of ambient light levels in proximity to the information handling system and wherein the ALS output is linearly scaled with respect to a display brightness of a display used with the information handling system;

modifying the display brightness based on a response curve stored for a user of the information handling system and the ALS output, the response curve for calibrating display brightness values positively versus the ALS output;

receiving user input to make a change in the display brightness, the change corresponding to a first brightness difference, wherein the ALS output does not change after the display brightness is modified based on the response curve and before the user input is received;

calculating a second brightness difference smaller than the first brightness difference and having the same sign as the first brightness difference, including applying a positive confidence factor F to the first brightness difference to calculate the second brightness difference, the positive confidence factor F selected to prevent any point in the response curve having a negative or zero slope;

modifying a display brightness value in the response curve corresponding to the ALS output by the second brightness difference to generate an updated response curve; and storing the updated response curve for the user in place of the response curve.

2. The method of claim 1, wherein the positive confidence factor F is less than 1.

3. The method of claim 2, wherein modifying the display brightness value in the response curve is not performed when the second brightness difference value results in any point in the response curve having a negative or zero slope.

4. The method of claim 1, wherein modifying the display brightness is performed using a timed transition from an old display brightness to a new display brightness over a predetermined time.

5. The method of claim 4, wherein the predetermined time is shorter when the new display brightness is greater than the old display brightness than when the new display brightness is lower than the old display brightness.

6. The method of claim 1, wherein the user input is subject to a minimum change sensitivity with respect to the display brightness and a minimum change response interval from a previous user input to change the display brightness, wherein the user input is not accepted when the minimum change sensitivity and the minimum change response interval are not satisfied.

7. A non-transitory computer-readable memory medium storing instructions, that, when executed by a processor, cause the processor to:

receive an ambient light sensor (ALS) output at an information handling system, wherein the ALS output is indicative of ambient light levels in proximity to the information handling system and wherein the ALS output is linearly scaled with respect to a display brightness of a display used with the information handling system;

modify the display brightness based on a response curve stored for a user of the information handling system and the ALS output, the response curve for calibrating display brightness values positively versus the ALS output;

receive user input to make a change in the display brightness, the change corresponding to a first brightness difference, wherein the ALS output does not change after the display brightness is modified based on the response curve and before the user input is received;

calculate a second brightness difference smaller than the first brightness difference and having the same sign as the first brightness difference, including applying a positive confidence factor F to the first brightness difference to calculate the second brightness difference, the positive confidence factor F selected to prevent any point in the response curve having a negative or zero slope;

modify a display brightness value in the response curve corresponding to the ALS output by the second brightness difference to generate an updated response curve; and store the updated response curve for the user in place of the response curve.

8. The memory medium of claim 7, wherein the positive confidence factor F is less than 1.

9. The memory medium of claim 8, wherein the instructions to modify the display brightness value in the response curve are not executed when the second brightness difference value results in any point in the response curve having a negative or zero slope.

10. The memory medium of claim 7, wherein the instructions to modify the display brightness are executed using a timed transition from an old display brightness to a new display brightness over a predetermined time, and wherein the predetermined time is shorter when the new display brightness is greater than the old display brightness than when the new display brightness is lower than the old display brightness.

11. The memory medium of claim 7, wherein the user input is subject to a minimum change sensitivity with respect to the display brightness and a minimum change response interval from a previous user input to change the display brightness, wherein the user input is not accepted when the minimum change sensitivity and the minimum change response interval are not satisfied.

12. An information handling system, comprising:

a processor enabled to access memory media storing instructions executable by the processor to:

receive an ambient light sensor (ALS) output at an information handling system, wherein the ALS output is indicative of ambient light levels in proximity to the information handling system and wherein the ALS output is linearly scaled with respect to a display brightness of a display used with the information handling system;

modify the display brightness based on a response curve stored for a user of the information handling system and the ALS output, the response curve for calibrating display brightness values positively versus the ALS output;

receive user input to make a change in the display brightness, the change corresponding to a first brightness difference, wherein the ALS output does not change after the display brightness is modified based on the response curve and before the user input is received;

calculate a second brightness difference smaller than the first brightness difference and having the same sign as the first brightness difference, including applying a positive confidence factor F to the first brightness difference to calculate the second brightness difference, the positive confidence factor F selected to prevent any point in the response curve having a negative or zero slope;

modify a display brightness value in the response curve corresponding to the ALS output by the second brightness difference to generate an updated response curve; and store the updated response curve for the user in place of the response curve.

13. The information handling system of claim 12, wherein the positive confidence factor F is less than 1.

14. The information handling system of claim 13, wherein the instructions to modify the display brightness value in the response curve are not executed when the second brightness difference value results in any point in the response curve having a negative or zero slope.

15. The information handling system of claim 12, wherein the instructions to modify the display brightness are executed using a timed transition from an old display brightness to a new display brightness over a predetermined time.

16. The information handling system of claim 15, wherein the predetermined time is shorter when the new display brightness is greater than the old display brightness than when the new display brightness is lower than the old display brightness.

17. The information handling system of claim 12, wherein the user input is subject to a minimum change sensitivity with respect to the display brightness and a minimum change response interval from a previous user input to change the display brightness, wherein the user input is not accepted when the minimum change sensitivity and the minimum change response interval are not satisfied.

* * * * *